United States Patent [19]

Buchholz et al.

[11] Patent Number: 4,765,204

[45] Date of Patent: Aug. 23, 1988

[54] METHOD OF MANUFACTURING A MOTIONLESS MIXER

[75] Inventors: Matthew Buchholz; Robert O. Zandt, both of Wichita, Kans.

[73] Assignee: Koch Engineering Company, Inc., Wichita, Kans.

[21] Appl. No.: 903,267

[22] Filed: Sep. 3, 1986

[51] Int. Cl.[4] ..... B21K 23/00; B01F 5/06

[52] U.S. Cl. ..... 76/101 R; 366/337; 165/135

[58] Field of Search ..... 366/336, 337, 338, 339, 366/340, 348, 349; 138/38, 40, 42, 46; 165/135; 48/180 R, 180 M, 180 B; 76/101 R

[56] References Cited

U.S. PATENT DOCUMENTS

| | | | |
|---|---|---|---|
| 3,235,003 | 2/1966 | Smith | 165/135 |
| 3,652,061 | 3/1972 | Chisholm | 366/337 |
| 4,511,258 | 4/1985 | Federighi et al. | 366/338 |

*Primary Examiner*—Roscoe V. Parker

*Attorney, Agent, or Firm*—Richard P. Crowley

[57] ABSTRACT

A motionless mixer for use in mixing flow streams in a conduit and a low-cost method of manufacturing the motionless mixer, which method comprises: cutting, such as by stamping, an elongated strip from a flat sheet, which strip comprises a plurality of connected, semielliptical blade elements; bending the strip at the connecting point between the blade elements, to form a plurality of blades at an angle of about 30°-45° to each other in the strip; providing first and second strips and aligning the first and second strips in a generally parallel arrangement; twisting the said first and second strips into a cooperative relationship, wherein each pair of blade elements is disposed at an angle of about 90° with respect to each other pair of blade elements; securing the blade elements together such as by welding at the crossover point of the pair of blade elements, to provide a motionless mixer; and inserting the motionless mixer in a conduit.

9 Claims, 1 Drawing Sheet

METHOD OF MANUFACTURING A MOTIONLESS MIXER

REFERENCE TO PRIOR APPLICATIONS

A motionless mixer for use in mixing turbulent flow streams in a conduit is described in U.S. patent application Ser. No. 774,927, now U.S. Pat. No. 4,643,584, filed Sept. 11, 1985 by Peter T. Allocca, which application is assigned to the common assignee as the present application; to wit, Koch Engineering Company, Inc. of Wichita, Kan. The prior application describes a motionless mixer which comprises at least first and second pairs of plate elements, with the plate elements composed of semielliptical portions. The semielliptical portions are disposed at an angle of about 30°–45° from the axis of the conduit. The first and second pairs of the semielliptical blade portions are disposed at an angle of about 90° with respect to each other in a conduit. The blade or plate elements of each respective pair overlap the blade or plate elements of the adjacent pair, to define a motionless mixer, particularly for use in the turbulent flow mixing of two or more fluid streams, with a low pressure drop per linear mixer link, and which motionless mixer exhibits good pickup characteristics. The motionless mixer so described provides for the blade elements to be secured together at the center of the semielliptical blade elements, where the blade elements cross on each pair, and further at the tips of each of the semielliptical blade elements at or about the middle edges of the adjacent pair of blade elements, with each first and second pair of blade elements requiring four securing or welding points. The blade elements of the motionless mixer are semielliptical in shape, with the plate elements of each pair overlapping the plate elements of the adjacent pair up to about one-half of the length of the blade elements.

BACKGROUND OF THE INVENTION

Static-mixing or motionless-mixing mixers have been found to be effective for mixing together two or more fluid streams. Typically, such static or motionless mixers comprise a plurality of baffle-type or plate-like elements disposed in a particular arrangement within a conduit, to provide for a plurality of subdivisions of the fluid stream, as two or more streams are passed from one to the other end of the conduit containing the motionless mixer. A wide variety of various baffle and plate designs of different shapes and geometric configurations have been proposed and used in connection with motionless mixers.

One motionless mixer which employs semielliptical blade elements is found in U.S. Pat. No. 3,652,061 which discloses a static-mixing element of angularly disposed baffles, which baffles deflex and mix two or more fluid streams. The individual blades of the baffle elements are firmly attached to the interior surface of the surrounding conduit. U.S. Pat. No. 3,235,003 discloses a plurality of various pairs of semielliptical baffle elements with a conduit to induce helical flow; however, this patent relates primarily to mufflers and heat exchangers in the mixing of gases. Another patent, U.S. Pat. No. 4,511,258, concerns a motionless mixer formed by deforming flat stock material. The mixing elements include substantially identical segments or halves, with the segments being axially staggered and in engagement with each other generally along the axis. Such a motionless mixer provides for connections between the points of engagement. The motionless mixer is composed of a plurality of identical, generally flat plates that are joined together, each at the opposite ends. The motionless mixer is formed by slitting a flat sheet substantially equal to the axial length of the ultimate length of the blades, with the slits being interconnected by connecting portions. The plates are then bent in opposite directions, to produce equal angles for the respective adjacent plates.

Typically, in the method of manufacturing motionless mixers, the material cost of the motionless mixer is quite low, while the manufacturing cost tends to be quite high. It is, therefore, desirable to provide for a method of manufacturing a motionless mixer and an effective motionless mixer, wherein the manufacturing of the motionless mixer is simple and at low cost, and wherein the number of welds or means to connect the respective blade elements of the motionless mixer is reduced, so as to effect a reduction in labor in the method of manufacturing.

SUMMARY OF THE INVENTION

The invention relates to a motionless mixer, and more particularly to a low-cost method of manufacturing a motionless mixer. In particular, the invention comprises a low-cost method of manufacturing a motionless mixer, which motionless mixer has a reduced number of connecting points per blade elements.

The method of manufacturing the motionless mixer of the invention comprises cutting, such as by flat punching out or stamping, an elongated strip from a flat sheet material, which strip comprises a plurality of flat, generally semielliptical blades, each having a curved outer edge and a flat inner edge on one and another end, with the cut blades connected together by connecting points, except for the blades at each end of the strip at the one or the other end, with the blades connecting in an alternate position sequence; that is, with the curved edge out and, on the next blade element, with the curved edge in the opposite direction. The method includes bending the cut strip at the connecting points in the strip in an alternate bending sequence, to form a plurality of blades, the blades being at an angle of about 35°–45° to each other in the strip, with the strips providing one-half of the motionless mixer to be formed. The method includes providing first and second identical one-half cut and bent strips, to make up a defined motionless mixer of the desired number of blade elements. The method includes aligning the first and second strips in a generally parallel, aligned relationship, and, thereafter, twisting the said first and second strips into a cooperative relationship with each other, wherein the twisted first and second strips form the complete motionless mixer unit. After twisting the first and second strips together, the blades form a plurality of pairs in which the semielliptical blades have the inner straight edge at an angle of about 30°–45° to each other; that is, disposed at an angle of about 30°–45° from the axis of the conduit in which the motionless mixer is to be inserted, and with the pairs disposed at an angle of about 90° with respect to each other. The plates of each pair overlap slightly the plate elements of the adjacent pair, although, unlike the prior copending application, the tips of the overlapping semielliptical blades have been removed. The method further comprises securing the strip elements together at or about the middle of the crossed inner straight edges of each of the blade elements, so as to form a fine motionless mixer. The motionless mixer as manufactured then may be inserted in an appropriate conduit, wherein the outer curved edges fit in a snug relationship against the inner conduit walls.

The method of manufacturing the motionless mixer is quite simple, has low cost and is not labor-intensive. The method of manufacturing involves a punching or stamping out of a fine blade pattern, to form a strip for one side of a defined number of blade elements of a motionless mixer, arranging two identical havles and bending the halves and then twisting the halves together, to form the complete motionless mixer, and, thereafter, securing, such as welding, at each crossover point of the blade, to retain together the plurality of blades of the motionless mixer, and, thereafter, inserting the formed motionless mixer, containing the single weld at the crossover points of each pair of blades, into an appropriate conduit. The motionless mixer so defined has adjacent pairs of blades rotated at about 90°, while adjacent pairs are also rotated at about 90°. Thus, in comparison to the motionless mixer of the prior copending application, which requires three welds for each pair of blades in the motionless mixer, the method of manufacturing the motionless mixer and the motionless mixer so produced require only a single weld for each pair of blades. Further, the motionless mixer of the invention does not require that the tips of the semielliptical blades be welded at their outer edges through the middle points of the curved edges of the adjoining overlapping blades. The motionless mixer prepared by the method and the method, while not providing the amount of blade overlap, as in the prior copending application, define a motionless mixer which performs in the same manner and function, but which is substantially simpler and has a lower cost of manufacturing.

The method of manufacturing the motionless mixer may employ any flat-type sheet material, either plastic or metal, but typically employs stainless-steel flat sheets, such as 16-gauge flat sheets. One-half of the motionless mixer may be stamped out and then a simple bending operation formed at the connecting points at one and the other ends of the stamped-out strip, so that the one-half units may be interchanged as desired. The alignment of each of the strip elements and the twisting together to form the motionless mixer is a relatively simple operation, as is the welding of the crossover points.

The invention will be described for the purpose of illustration only in connection with the preferred and illustrated method of manufacturing a semielliptical motionless mixer; however, it is recognized that the method of manufacture may be equally applicable to circular or other shape blade elements, and that alterations, changes and improvements may be made to the method of manufacture by those persons skilled in the art, all without departing from the spirit and scope of the invention.

DESCRIPTION OF THE EMBODIMENTS

Figure 1:
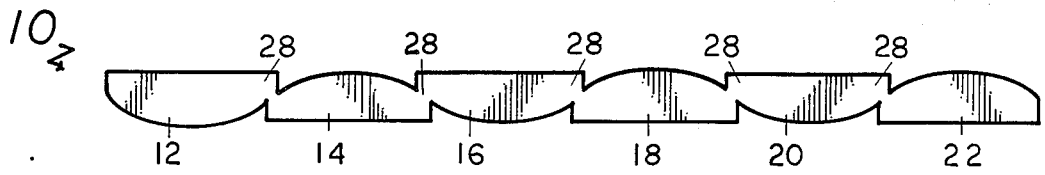
FIG. 1 is a plan view of a cut strip containing a plurality of blades.

FIG. 1 illustrates a six-blade element 10 which has been flat punched out of a flat sheet of 16-guage stainless steel, and wherein the blade elements 12, 14, 16, 18, 20 and 22 are arranged in a flat alternate sequence, with a curved edge 24 facing alternately in a different direction, and a straight edge 26 facing alternately in a different direction, and with the respective blades, which are illustrated as being semielliptical in shape, being connected at the one or the other end through a short integral connecting piece 28. The blade illustrated is for one side or to form one-half of a motionless mixer.

Figure 2:
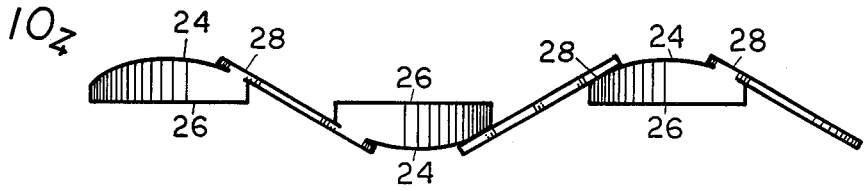
FIG. 2 shows the cut strip of FIG. 1 after bending.

FIG. 2 is an illustration of the blade strip 10 of FIG. 1 which has been bent at the connecting pieces 28, so as to form a generally helical, six-blade twisted element. The blades 12, 14, 16, 18, 20 and 22 are disposed at an angle of approximately 30°–45° to each other. As illustrated in FIGS. 1 and 2, the semielliptical blades do not have sharp tips and, therefore, do not extend in an overlapping manner, as much as the blades illustrated in the prior copending application made of reference, which requires the tips of the blades to be secured to the curved outside edges of the blades on which they overlap.

Figure 3:
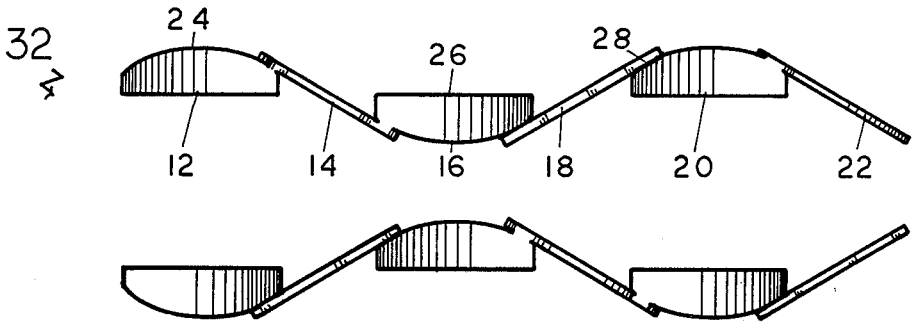
FIG. 3 shows the alignment of first and second bent strips of FIG. 2 that are to be twisted into a complete motionless mixer.

FIG. 3 shows the stamped, bent blade strip 10 aligned in a generally parallel arrangement as a pair 32 ready to be twisted together, to form the complete motionless mixer.

Figure 4:
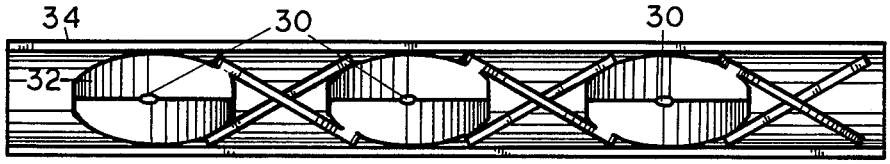
FIG. 4 shows the completed motionless mixer after twising and inserting into a conduit.

FIG. 4 shows the arrangement 32; that is, the two, stamped, bent, one-half, six-blade elements 10, secured together at the crossover points of the inner straight edge by a weld 30, with each adjacent pair disposed at an angle of approximately 90° to the other adjacent pair, so that each blade element in each pair is disposed at an angle of about 45°, and inserted in a tubular conduit 34 for use as a motionless mixer in the mixng of two or more fluids passed from the one to the other end of the conduit 34. As illustrated, the method of manufacturing of the motionless mixer components is quite simple, requiring merely a cutting; that is, a flat-punching operation, a simple bending operation and then an aligning and a twising operation, followed by a single weld for each pair of elements and then insertion into a conduit to complete a motionless mixer. This method of manufacture overcomes the labor-intensive prior techniques of forming such motionless mixers.

The motionless mixer so prepared is unique, in that each pair of blades has truncated tips, with a portion of the ends of each of the outer curved section integrally connected to the adjoining blade through the connecting tab 28, while the middle of the straight-edge inner portions of the blades is secured together at the desired angle by a simple weld. The method of manufacture has been described for the purpose of illustration only in connection with a semielliptical, nontipped blade element; however, it is recognized that other blade elements of various shapes may be stamped, bent, aligned, twisted and welded in the method of manufacture, such as, for example, the employment of semispherical elements for the blade elements. The method of manufacturing the motionless mixer provides for a low-cost method of manufacture, while the motionless mixer illustrated provides for good pickup characteristics and low pressure drop, is of an open-plug design and is simply installed and removed from a mixing conduit.

What is claimed is:

1. A method of manufacturing a motionless mixer, which method comprises:

(a) cutting from a flat sheet material an elongated strip, which strip comprises a defined plurality of blades, each blade defined by a curved edge and a flat edge and having a one and another end, the blades connected together, except for the blades at each end of the strip, at the one and the other end with the adjoining blade, the blades arranged in a flat, alternate position sequence as to the curved edge and flat edge;

(b) bending the strip composed of the blades at the connecting area in the strip, to form a plurality of blades in the strip at an angle of about 30°–45° to each other, to provide a strip composed of bent blades or one-half of a motionless mixer;

(c) twisting first and second identical strip elements into a cooperative relationship, wherein the straight edges of the blade elements cross over each other at a defined angle, and the curved edges are disposed outwardly, so that the blades form a plurality of blade pairs, the blade pairs adjacent to each other at an angle of about 90°; and (d) securing the blades together at the crossover points of the straight edges of the blades.

2. The method of claim 1 which includes inserting the motionless mixer so formed into a conduit.

3. The method of claim 1 wherein the blades cross each other at each pair at an angle of about 45°.

4. The method of claim 1 wherein the blades of each pair are secured to each other at the crossover points by welding.

5. The method of claim 1 wherein cutting the flat sheet material comprises flat punching out the desired pattern from a sheet material.

6. The method of claim 1 wherein the blades form semielliptical blade elements being truncated at each end thereof.

7. The motionless mixer produced by the method of claim 1.

8. A method of manufacturing a motionless mixer, which method comprises:

(a) flat punching out a defined pattern from a flat sheet material to an elongated strip, which strip comprises a plurality of flat, truncated, semielliptical blades, each blade having a curved edge, a flat straight edge and one and the other ends, the blades connected together at their truncated one and the other ends, except for the blades at the end of each strip, the blades connected in an alternate position sequence as to the curved and straight edges;

(b) bending the flat strip at the connecting areas in an alternate sequence, to form a plurality of semielliptical blades, each blade being at an angle from the plane of the other blade of about 30°–45° in the strip, which stamped and bent strip is to provide one-half of a motionless mixer;

(c) aligning first and second identical strip elements in a generally parallel arrangement;

(d) twisting the first and second strip elements into a cooperative relationship, wherein the semielliptical blades of the first and second strips form a plurality of blade pairs, with the straight edge being in a crossover relationship, and the curved edge forming an outer curved edge, and with each pair of blades disposed at an angle of approximately 90° to the adjoining pair of blades;

(e) welding the inner straight edges of the blades together at approximately the crossover point of the middle of the straight edge of each pair; and (f) inserting the motionless mixer so formed into a conduit.

9. The motionless mixer produced by the method of claim 8.

* * * * *